US011658439B2

(12) United States Patent
Kuo

(10) Patent No.: US 11,658,439 B2
(45) Date of Patent: May 23, 2023

(54) MALE PLUG AND FEMALE RECEPTACLE OF CONNECTOR AND DOCKING STRUCTURE THEREOF

(71) Applicant: GETAC TECHNOLOGY CORPORATION, Hsinchu County (TW)

(72) Inventor: Hsiu-Yu Kuo, Taipei (TW)

(73) Assignee: Getac Technology Corporation, Hsinchu County (TW)

( * ) Notice: Subject to any disclaimer, the term of this patent is extended or adjusted under 35 U.S.C. 154(b) by 35 days.

(21) Appl. No.: 17/179,601

(22) Filed: Feb. 19, 2021

(65) Prior Publication Data

US 2021/0257779 A1 Aug. 19, 2021

Related U.S. Application Data

(60) Provisional application No. 62/978,431, filed on Feb. 19, 2020.

(30) Foreign Application Priority Data

Sep. 17, 2020 (CN) ..... 202010981091.7

(51) Int. Cl.
*H01R 13/62* (2006.01)
*H01R 13/627* (2006.01)
*H01R 13/633* (2006.01)

(52) U.S. Cl.
CPC ..... *H01R 13/6273* (2013.01); *H01R 13/6335* (2013.01)

(58) Field of Classification Search
CPC ..... H01R 13/5219; H01R 13/6582; H01R 13/639; H01R 13/523; H01R 2201/26
See application file for complete search history.

(56) References Cited

U.S. PATENT DOCUMENTS 4,443,048 A * 4/1984 Moist, Jr. ..... H01R 13/424 439/746
4,832,615 A * 5/1989 Thakrar ..... H01R 13/5219 439/272
4,974,075 A * 11/1990 Nakajima ..... H04N 5/23203 348/E5.025
5,876,248 A * 3/1999 Brunker ..... H01R 12/75 439/660
5,915,987 A * 6/1999 Reed ..... H01R 13/6275 439/258
6,152,769 A * 11/2000 Gimenes ..... H01R 13/5205 439/598
6,322,395 B1 * 11/2001 Nishio ..... H01R 13/6594 439/607.11
6,358,091 B1 * 3/2002 Lo ..... H01R 13/6471 439/607.41

(Continued)

*Primary Examiner* — Truc T Nguyen

(57) ABSTRACT

A male plug and a female receptacle and a docking structure thereof include a male plug and a female receptacle docked with each other. When the male plug and the female receptacle docked with each other, the male plug is fitted with the female receptacle using a horizontal holding force provided by a first fastening structure, and is fitted with the female receptacle using a vertical holding force provided by a second fastening structure, hence further reinforcing plugging stability between the male plug and the female receptacle by the horizontal and vertical holding forces.

17 Claims, 4 Drawing Sheets

(56) References Cited

U.S. PATENT DOCUMENTS

| | | | | |
|---|---|---|---|---|
| 7,568,934 | B1 * | 8/2009 | Williams | H01R 13/6277 439/271 |
| 2006/0286864 | A1 * | 12/2006 | Bethurum | H01R 24/20 439/595 |
| 2012/0184127 | A1 * | 7/2012 | Hanyu | H01R 13/6273 439/370 |
| 2018/0011256 | A1 * | 1/2018 | Yodogawa | G02B 6/4292 |

* cited by examiner

MALE PLUG AND FEMALE RECEPTACLE OF CONNECTOR AND DOCKING STRUCTURE THEREOF

CROSS-REFERENCE TO RELATED APPLICATIONS

The present application claims the benefit of U.S. provisional Patent Application No. 62/978,431, filed on Feb. 19, 2020, the disclosure of which is hereby incorporated by reference herein in its entirety. The present application further claims priority to a CN Patent Application No. 202010981091.7, filed on Sep. 17, 2020, the disclosure of which is also hereby incorporated by reference herein in its entirety.

BACKGROUND OF THE INVENTION

Field of the Invention

The present invention relates to a connector, and more particularly to a male plug and a female receptacle of a connector and a docking structure thereof.

Description of the Prior Art

Some industrial computers used for special standards, military standards or vehicles commonly adopt USB connectors as connectors for connection for signal or data transmissions. Moreover, in order to be used in coordination with universal standards, connectors in universal standards such as USB Type-C are also designed.

In general, universal standards are common in applicable scenarios or environments, and so testing performed on these universal standards may not be as strict as those used in special circumstances such as industrial computers. If a connector of a universal standard is to be directly configured and used in an industrial computer, issues such as inapplicability and hence reduced durability may be caused. For example, considering that a common USB Type-C connector is used in general utilization states, the holding force during plugging of such connector is not particularly designed by taking into account the conditions of an industrial computer, and so such connector is susceptible to be disengaged when pulled by an external force, causing problems of data or communication interruptions. If a universal standard is to be used, further improvement needs to be made so as to satisfy special application scenarios while also complying to the universal standard.

In view of the above, on the basis of extensive development with the practice of theories, the inventor has provided an invention with a reasonable design and effectively improving the issues above in aim of improving and resolving the above issues above.

SUMMARY OF THE INVENTION

It is a primary object of the present invention to provide a male plug and a female receptacle of a connector and a docking structure thereof. While maintaining a docking design of a universal standard, a plugging structure is further reinforced, so that the female receptacle remains applicable to a common universal standard and provides an even more stable plugging structure when plugged with the male plug.

It is another object of the present invention to provide a male plug and a female receptacle of a connector and a docking structure thereof, which may adopt a universal standard such as USB Type-C.

To achieve the above objects, a male plug of a connector provided by the present invention includes a plug body and a male connector. The plug body includes a plug head and a plurality of plug elastic pieces extending forward from a periphery of the plug head. The plug head has a plug end surface facing forward, and the male connector is provided in the plug head, protrudes from the plug end surface and is surrounded by the plug elastic pieces. The male connector has therein a first fastening structure, and a second fastening structure is provided on each of the elastic pieces.

To achieve the above objects, a female receptacle of a connector provided by the present invention includes a receptacle body and a female connector. The receptacle body includes a receptacle base and a receptacle member. The receptacle member has therein a hollow receiving space, and a receiving port formed by extending outward from the receiving space. The receptacle base is provided in the receiving space and has a receptacle end surface facing the receiving port, the female connector has a plugging port and is provided in the receptacle base, and the plugging port is exposed from the receptacle end surface.

To achieve the above objects, a connector docking structure provided by the present invention includes a female receptacle and a male plug. The female receptacle includes a receptacle body and a female connector. The receptacle body includes a receptacle base and a receptacle member. The receptacle member has therein a hollow receiving space, and a receiving port formed by extending outward from the receiving space. The receptacle base is provided in the receiving space, and an encircling receiving gap is formed between the receptacle base and a peripheral of an inner wall of the receiving space. The receptacle base further has a receptacle end surface facing the receiving port, the female connector is provided in the receptacle base and has a plugging port exposed from the receptacle end surface. The male plug includes a plug body and a male connector. The male connector has therein a first fastening structure. The plug body has a plug head and a plurality of plug elastic pieces extending forward from a periphery of the plug head. The plug head has a plug end surface facing forward, and the male connector is provided in the plug head, protrudes from the plug end surface and is surrounded by the plug elastic pieces. Each of the plug elastic pieces is provided with a second fastening structure. When the male plug is docked with the female receptacle, the plug elastic pieces are plugged into the receiving gap, the male connector is fitted with the female connector by the first fastening structure, and the male plug is fitted with the female receptacle by the second fastening structures.

DETAILED DESCRIPTION OF THE EMBODIMENTS

To enable the examiner to better understand the features and technical contents of the present invention, details of the present invention are given with the accompanying drawings below. It should be noted that the accompanying drawings are for reference and illustration purposes and are not to be construed as limitations to the present invention.

Figure 1:
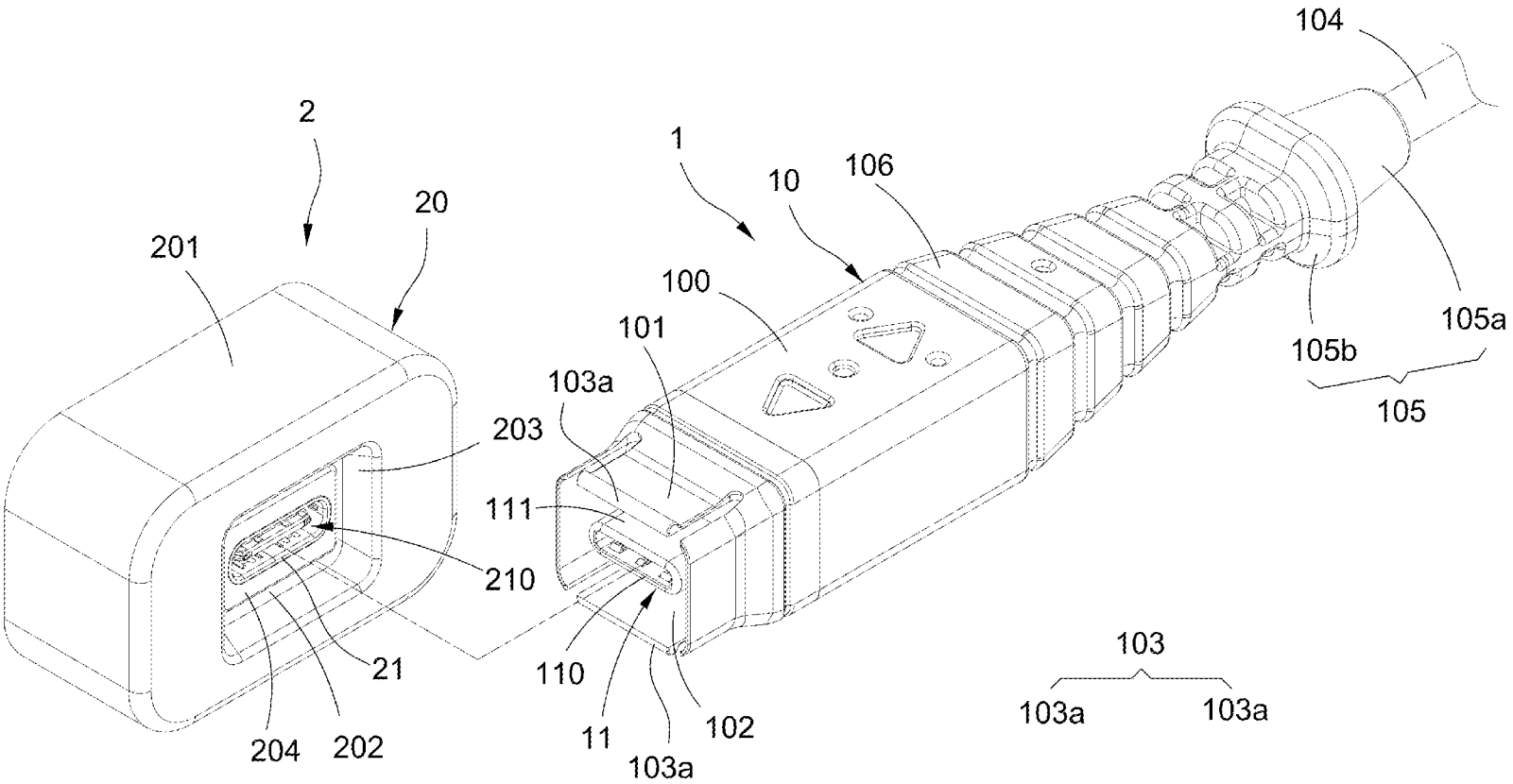
FIG. 1 is an exploded three-dimensional schematic diagram of a male plug and a female receptacle of the present invention.

FIG. 1 shows a three-dimensional exploded schematic diagram of a male plug and a female receptacle of the present invention. Referring to FIG. 1, the present invention provides a male plug and a female receptacle of a connector and a docking structure thereof, including a male plug 1, and a female receptacle 2 matching docking with the male plug 1.

Figure 4:
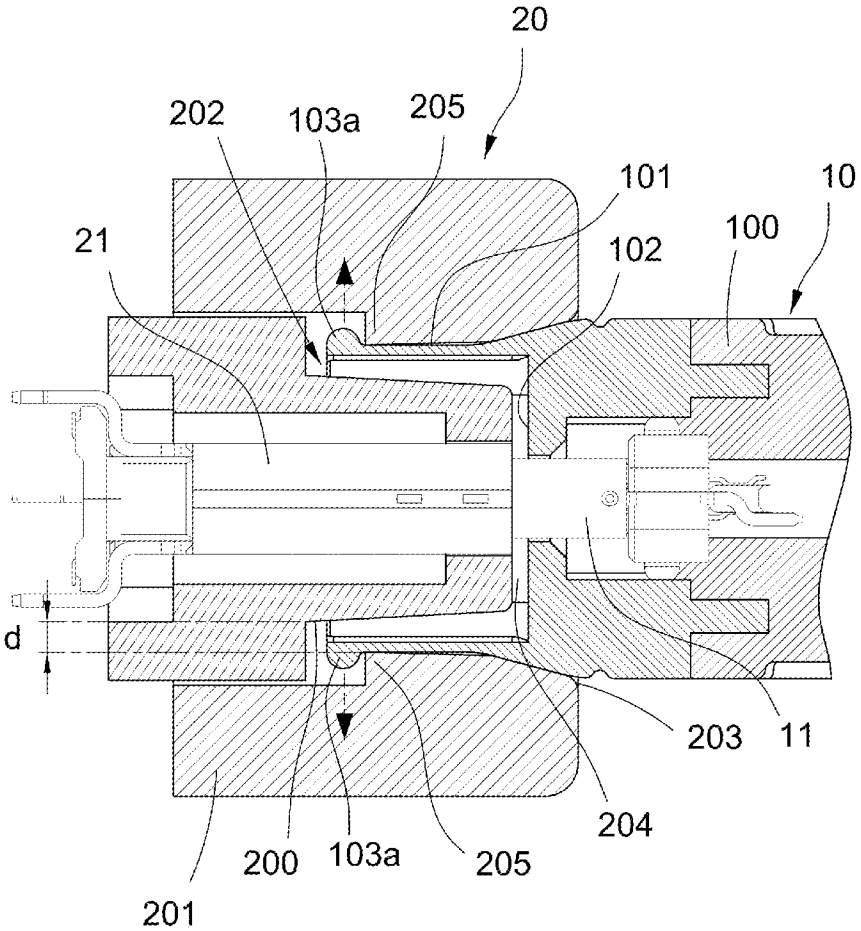
FIG. 4 is a section schematic diagram of an assembly of a male plug and a female receptacle of the present invention.

The male plug 1 includes a plug body 10 and a male connector 11. The plug body 10 includes a plug head 100 and a plurality of plug elastic pieces 101 extending forward from a periphery of the plug head 100. The plug head 100 has a plug end surface 102 (as shown in FIG. 4) facing forward. The male connector 11 is provided in the plug head 100 of the plug body 10, protrudes from the plug end surface 102 and is surrounded by the plug elastic pieces 101.

Figure 2:
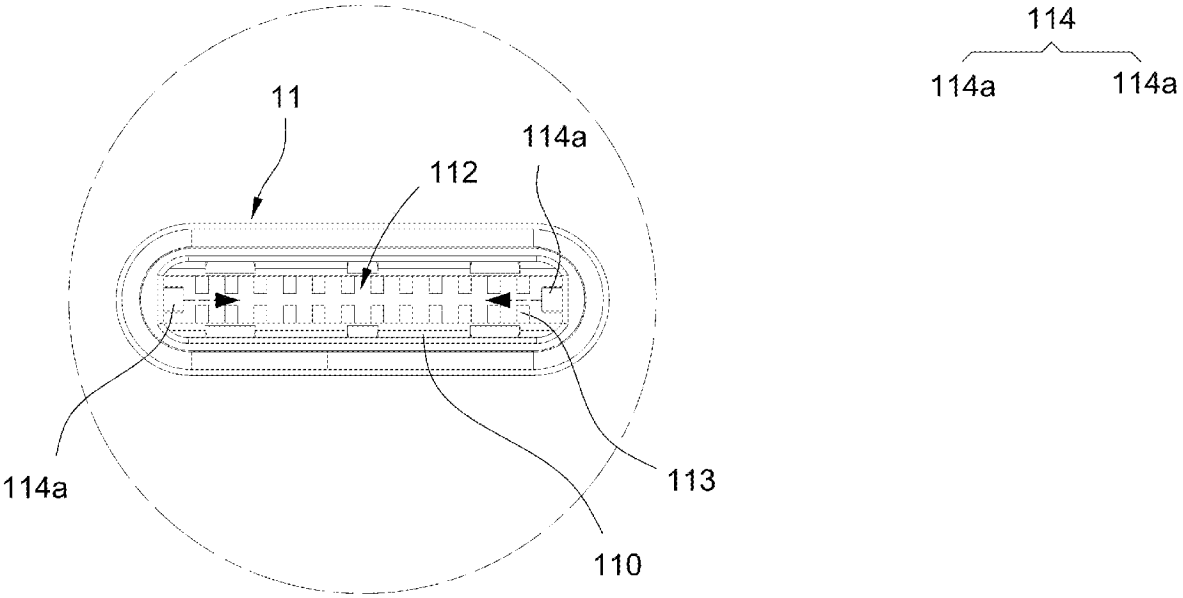
FIG. 2 is a schematic diagram of an end surface of a male terminal of a connector of the present invention.

As shown in FIG. 2, the foregoing male connector 11 may be a connector in the USB Type-C standard, and has a male tongue 110 and a covering housing 111 covering outside the male tongue 110. The male tongue 110 has a connector port 112, a plurality of male terminals 113 are respectively provided on upper and lower parts of an inner wall of the connector port 112, and a first fastening structure 114 is provided on each of two sides of the inner wall of the connector port 112.

As shown in FIG. 1, FIG. 2 and FIG. 4, the male plug 1 and the matching female receptacle 2 docked thereto achieve plugging stability through the first fastening structures 114 and a second fastening structures 103. Moreover, as shown in FIG. 2, the first fastening structure 104 may be two snapping arms 114*a* respectively provided on inner lateral sides of the connector port 112, and the two snapping arms 114*a* protrude inward so as to provide a horizontal holding force to be applied on the female receptacle 2. As shown in FIG. 4, the second fastening structure 103 may be two clamping edges 103*a* respectively located on upper and lower parts of the covering housing 111, and the two clamping edges 103*a* protrude outward so as to provide a vertical holding force to be applied on the female receptacle 2.

Further, as shown in FIG. 1, the plug body 10 further includes a cable 104 extending from an end of the plug head 100, a pulling portion 105 is formed between the plug head 100 and the cable 104, and a buffer structure 106 is further extended from the end of the plug head 100, wherein the pulling portion 105 can be integrally connected to an end of the buffer structure 106 so as to form a cable connector. It should be noted that, the pulling portion 105 may further include a concentrator section 105*a*, and a holding ring 105*b* connected between the buffer structure 106 and the concentrator section 105*a*. The holding ring 105*b* is radially greater than the concentrator section 105*a* and the end of the buffer structure 106, so as to facilitate the hand to hold the holding ring 105*b* of the pulling portion 105 to apply a force on the male plug 1, further removing or separating the male plug 1 from the female receptacle 2.

Again referring to FIG. 1 and FIG. 4, the female receptacle 2 includes a receptacle body 20 and a female connector 21. The receptacle body 20 includes a receptacle base 200 and a receptacle member 201. The receptacle member 201 has therein a hollow receiving space 202, and a receiving port 203 formed by extending outward from the receiving space 202. The receptacle base 200 is provided in the receiving space 202, and an encircling receiving gap d (as shown in FIG. 4) is formed between the receptacle base 200 and a peripheral of an inner wall of the receiving space 202. The receptacle base 200 further has a receptacle end surface 204 facing the receiving port 203, and the female connector 21 is provided in the receptacle base 200 and has a plugging port 210 exposed from the receptacle end surface 204.

Figure 3:
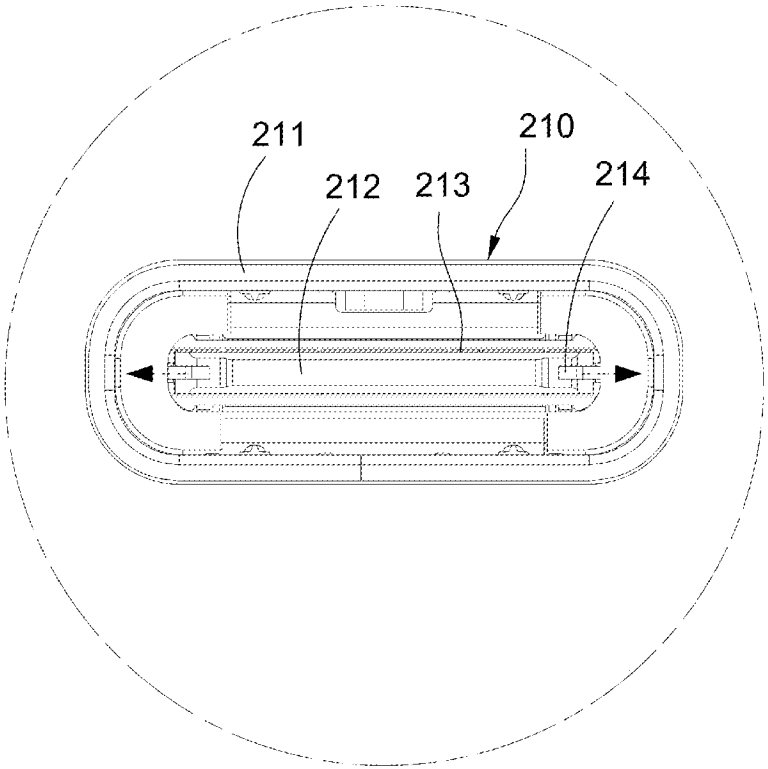
FIG. 3 is a schematic diagram of an end surface of a female terminal of connector of the present invention.

As shown in FIG. 3, the female receptacle 21 may also be a connector in the USB Type-C standard, and includes a shielding housing 211 forming the plugging port 210, and a female tongue 212 located in the shielding housing 211. The female tongue 212 is provided with a plurality of female terminals 212, and two fitting edges 214 for fastening with the first fastening structures 114, and the female terminals 213 correspond to the male terminals 113, as shown in FIG. 2.

Again referring to FIG. 1, FIG. 3 and FIG. 4, the receptacle member 201 may be provided with two fitting walls 205 respectively located on upper and lower parts of an inner wall of the receiving space 202. The two fitting walls 205 are for fastening with the second fastening structures 103 of the male connector 11, so as to enable the second fastening structures 103 to provide the foregoing vertical holding force to be applied on the female receptacle 2.

Again referring to FIG. 4, when the male plug 1 is docked with the female receptacle 2, the plug elastic pieces 101 of the male plug 1 are plugged into the receiving gap d of the female receptacle 2, the male connector 11 is fitted with the female connector 21 by the first fastening structures 114, and the male plug 1 is fitted with the female receptacle 2 with the second fastening structures 103.

Accordingly, the male plug and the female receptacle of a connector and the docking structure thereof of the present invention can be obtained as the structural configurations above.

Thus, with the male plug and the female receptacle of a connector and the docking structure thereof, the plugging stability between the male plug 1 and the female receptacle 2 is reinforced by the foregoing horizontal and vertical holding forces.

In conclusion, the present invention achieves the expected application objects, solves the issues of the prior art, and is novel and involves an inventive step, fully meeting the requirements of a patent application. Therefore, a patent application is filed accordingly, and granting the application with patent rights is respectfully requested to ensure rights of the inventor.

Preferred feasible embodiments of the present invention are described as above, and are not to be construed as limitations to the scope of protection of the present invention. Similarly, equivalent changes made to the techniques and means practicing the contents of the description and drawings of the present invention are to be encompassed within the scope of the present invention.

What is claimed is:

1. A male plug of a connector, comprising:

a plug body, having a plug head and a plurality of plug elastic pieces extending forward from a periphery of the plug head, the plug head having a plug end surface facing forward; and a male connector, provided in the plug head, protruding from the plug end surface and surrounded by the plug elastic pieces;

wherein, the male connector has therein a first fastening structure, and the plug elastic pieces are provided with respective second fastening structures, and wherein the male connector has a male tongue and a covering housing covering outside of the male tongue, the male tongue has a connector port, and a plurality of male terminals and the first fastening structure are provided on an inner wall of the connector port.

2. The male plug of a connector according to claim 1, wherein the first fastening structure is two snapping arms respectively provided on inner lateral sides of the connector port, and the second fastening structures are two clamping edges respectively located on upper and lower parts of the covering housing.

3. The male plug of a connector according to claim 2, wherein the two snapping arms protrude inward and the two clamping edges protrude outward.

4. The male plug of a connector according to claim 1, wherein the plug body further has a cable extending from an end of the plug head, and a pulling portion is formed between the plug head and the cable.

5. The male plug of a connector according to claim 4, wherein a buffer structure is further extended from the end of the plug head, and the pulling portion is integrally connected to an end of the buffer structure.

6. The male plug of a connector according to claim 5, wherein the pulling portion has a concentrator section, and a holding ring connected between the buffer structure and the concentrator section, and the holding ring is radially greater than the concentrator section and the end of the buffer structure.

7. A female receptacle of a connector, comprising:

a receptacle body, comprising a receptacle base and a receptacle member, the receptacle member having therein a hollow receiving space and a receiving port formed by extending outward from the receiving space, the receptacle base being provided in the receiving space and having a receptacle end surface facing the receiving port; and a female connector, having a plugging port, the female connector being provided in the receptacle base, the plugging port being exposed from the receptacle end surface;

wherein the female connector has a shielding housing forming the plugging port and a female tongue located in the shielding housing, and the female tongue is provided with a plurality of female terminals and two fitting edges.

8. The female receptacle of a connector according to claim 7, wherein the receptacle member is provided with two fitting walls respectively located on upper and lower parts of an inner wall of the receiving space.

9. A docking structure of a male terminal of a connector, comprising:

a female receptacle, comprising a receptacle body and a female connector; wherein, the receptacle body comprises a receptacle base and a receptacle member, the receptacle member has therein a hollow receiving space and a receiving port formed by extending outward from the receiving space, the receptacle base is provided in the receiving space, an encircling receiving gap is formed between the receptacle base and a peripheral of an inner wall of the receiving space, the receptacle base further has a receptacle end surface facing the receiving port, and the female connector is provided in the receptacle base and has a plugging port exposed from the receptacle end surface; and a male plug, comprising a plug body and a male connector; wherein, male connector has therein a first fastening structure, the plug body has a plug head and a plurality of plug elastic pieces extending forward from a periphery of the plug head, the plug head has a plug end surface facing forward, the male connector is provided in the plug head, protrudes from the plug end surface and is surrounded by the plug elastic pieces, and the plug elastic pieces are provided with respective second fastening structures;

wherein, when the male plug is docked with the female receptacle, the plug elastic pieces are plugged into the receiving gap, the male connector is fitted with the female connector by the first fastening structure, and the male plug is fitted with the female receptacle by the second fastening structures.

10. The docking structure of a male terminal of a connector according to claim 9, wherein the female connector has a shielding housing forming the plugging port and a female tongue located in the shielding housing, and the female tongue is provided with a plurality of female terminals and two fitting edges for fastening with the first fastening structure.

11. The docking structure of a male terminal of a connector according to claim 10, wherein the receptacle member is provided with two fitting walls respectively located on upper and lower parts of an inner wall of the receiving space, and the two fitting walls are for fastening with the second fastening structures.

12. The docking structure of a male terminal of a connector according to claim 11, wherein the male connector has a male tongue for plugging into the plugging port and a covering housing covering outside of the male tongue, the male tongue has a connector port for receiving the female tongue, and a plurality of male terminals for contacting with the female terminals and the first fastening structure are provided on an inner wall of the connector port.

13. The docking structure of a male terminal of a connector according to claim 12, wherein the first fastening structure is two snapping arms respectively provided on inner lateral sides of the connector port, and the second fastening structures are two clamping edges respectively located on upper and lower parts of the covering housing.

14. The docking structure of a male terminal of a connector according to claim 13, wherein the two snapping arms protrude inward and the two clamping edges protrude outward.

15. The docking structure of a male terminal of a connector according to claim 9, wherein the plug body further has a cable extending from an end of the plug head, and a pulling portion is formed between the plug head and the cable.

16. The docking structure of a male terminal of a connector according to claim 15, wherein a buffer structure is further extended from the end of the plug head, and the pulling portion is integrally connected to an end of the buffer structure.

17. The docking structure of a male terminal of a connector according to claim 16, wherein the pulling portion has a concentrator section, and a holding ring connected between the buffer structure and the concentrator section, and the holding ring is radially greater than the concentrator section and the end of the buffer structure.

* * * * *